US005090332A

United States Patent [19]

Edwards et al.

[11] Patent Number: 5,090,332

[45] Date of Patent: Feb. 25, 1992

[54] SELF-CENTERING MODEL RAILROAD CAR TRUCK ASSEMBLY

[75] Inventors: Clarence K. Edwards, Medford; Lawrence D. Edwards, Eagle Point, both of Oreg.

[73] Assignee: Kadee Metal Products Co., Medford, Oreg.

[21] Appl. No.: 580,202

[22] Filed: Sep. 10, 1990

[51] Int. Cl.[5] ..... B61F 3/00

[52] U.S. Cl. ..... 105/157.2; 104/263

[58] Field of Search ..... 104/262, 263, 272, DIG. 1; 105/1.5, 157.2, 199.4, 238.2

[56] References Cited

U.S. PATENT DOCUMENTS

| | | | |
|---|---|---|---|
| 671,178 | 4/1901 | Bollinger et al. | 104/262 X |
| 701,207 | 5/1902 | Ludlow | 104/262 X |
| 1,791,660 | 2/1931 | Corey | 104/DIG. 1 X |
| 2,284,998 | 6/1942 | Varney | 105/157.2 X |
| 3,828,689 | 8/1974 | Raffenberg | 104/262 X |
| 4,522,607 | 6/1985 | Kilroy et al. | 104/DIG. 1 X |

*Primary Examiner*—Robert J. Oberleitner
*Assistant Examiner*—S. Joseph Morano
*Attorney, Agent, or Firm*—Kolisch, Hartwell, Dickinson, McCormack & Heuser

[57] ABSTRACT

A self-centering truck assembly is intended for use on model-railroad cars. Model rail cars have some form of truck-mounting structure thereon which provide a way to mount trucks to the car. A truck is provided which includes an elongate bolster extending between its sides. A self-centering cam is provided and is operable to center the trucks such that the bolster axis is oriented normal to a longitudinal axis of the car.

7 Claims, 1 Drawing Sheet

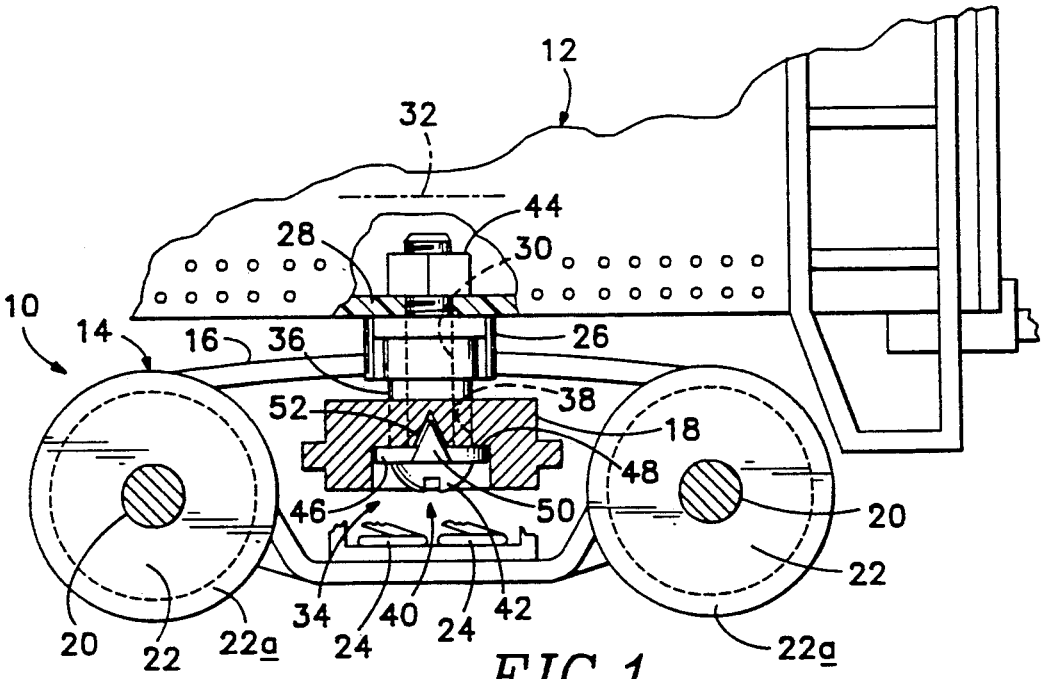
FIG. 1
FIG. 2
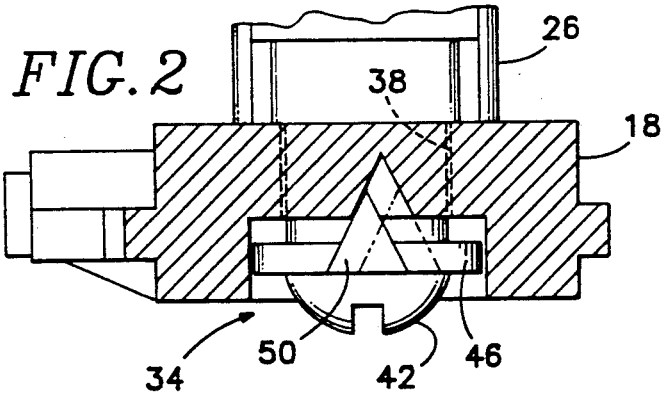
FIG. 3
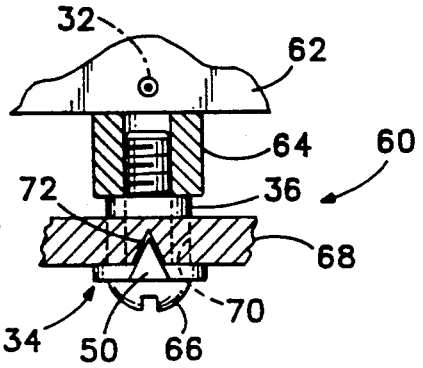

SELF-CENTERING MODEL RAILROAD CAR TRUCK ASSEMBLY

BACKGROUND OF THE INVENTION

This invention relates to model railroad cars, and specifically to a self-centering truck assembly which facilitates easy placement of a model rail car on a track.

Placing model rail cars on a model railroad track can be one of the more time consuming and frustrating operations in running a model railroad. When one is a member of a club, and frequently transports a large volume of rolling stock between a home layout and a club layout, placement of model rail cars on tracks is extremely time consuming.

Another problem, particularly with smaller gauge railroads, arises when young children are introduced to model railroading before they acquire the requisite motor skills and patience necessary to handle relatively small rail cars and engines.

One known technique for placing cars on tracks is the provision of guides, sometimes called re-railers, which are built into the track. Re-railers guide the wheels of a rail car on the track rails when the car is moved over that particular portion or section of track.

Such a re-railer includes a center safety guide, such as is found on prototype pikes, which provides clearance for wheel flanges and which has a V-shaped throat at each end. An external rail or platform is provided to lift a wheel flange which is outside of the main rail to the level of the rail top surface. The flange may then be positioned between the rail pair forming a track.

A problem with this type of re-railer is that only a particular portion or section of track is available for railing of cars on the rails, to the exclusion of the other sections of track. Even if several such re-railers are provided on a layout, the odds of a re-railer being located at the necessary location for all railings, except the initial placement, are small. De-railments rarely occur in proximity to a re-railer. Additionally, such a re-railer may produce slight nicks in the wheels and wheel flanges as the cars are moved over the rails in a non-railed condition.

Another known device is a railing ramp, which may be formed of metal or plastic. The railing ramp is manually placed over the track, and guides the wheels of a model rail car onto the rails.

To use such a device, there must be several of the devices scattered about the layout, particularly in the case of layouts that extend over hundreds or thousands of square feet.

Finally, a model rail car may be placed on the tracks by lowering one's head down to track level, picking up the car and very tediously placing the car and the wheels on the tracks with the wheels properly railed on the tracks. Manual placement of rail cars on a track is sometimes difficult for the very young, or for the more mature model railroader. This is, of course, the oldest known way to place model rail cars on tracks. This is also the reason that the aforementioned devices and techniques, as well as the truck assembly of the invention, have been created.

An object of the invention is to provide a railing assembly which will facilitate placement of a model rail car on railroad tracks.

Another object of the invention is to provide a self-centering truck assembly which will align the trucks on a model rail car with the longitudinal axis of the car, thereby facilitating the placement of the car on the tracks.

Another object of the invention is to provide a self-centering truck assembly which includes a self-centering cam which causes the trucks on a car to center themselves.

A further object of the invention is to provide a self-centering truck assembly which is easily retrofit onto existing model rail rolling stock.

SUMMARY OF THE INVENTION

The self-centering truck assembly of the invention is intended for use on model-railroad cars. Model rail cars have some form of truck-mounting means which provide a way to mount trucks to the car. A truck is provided which includes an elongate bolster extending between the sides of the truck. A self-centering cam is provided and is operable to center the trucks such that the bolster axis is oriented normal to a longitudinal axis of the car. This facilitates placement of the car on the track.

These and other objects and advantages of the invention will be more fully appreciated as the description which follows is read with the drawings.

BRIEF DESCRIPTION OF THE DRAWINGS

FIG. 1 is a side elevation of the self-centering truck assembly of the invention, with portions broken away to show detail.

FIG. 2 is an enlarged side elevation of a portion of FIG. 1, with the bolster of the invention slightly turned.

FIG. 3 is a modified form of the truck assembly of the invention which is intended as a retrofit to existing rolling stock.

DETAILED DESCRIPTION OF THE PREFERRED EMBODIMENTS

Turning initially to FIG. 1, a self-centering model-railroad-car-truck assembly is depicted at 10. Assembly 10 is attached to a model rail car 12. As depicted in FIG. 1, car 12 is shown in an elevated position, such that assembly 10 is freely depending from the bottom of car 12.

Truck assembly 10 includes a model rail car truck 14, which in turn includes a side piece 16 on each side of the truck, and a bolster 18, extending laterally between the side pieces. In addition to bolster 18, an axle 20 having wheels 22, extends between the sides of the truck at the front and rear of the truck. Each wheel includes a flange **22*a*, which extends below the upper surface of a rail and keeps the wheel on the rails. Bolster 18 is supported between side pieces 16 by springs 24**.

Car 12 includes truck mounting means, which in the embodiment depicted in FIG. 1, includes a transversely extending plate 26. Plate 26 extends across the width of the lower side of car floor 28. Plate 26 has a bore 30 extending therethrough, which bore also extends through floor 28. Bore 30 is located at the center of car 12 and is located on the longitudinal axis 32 of the car.

Assembly 10 includes a self-centering cam which is depicted at 34. Cam 34 includes a collar 36, which extends through a bore 38 in bolster 18. Collar 36 is frictionally fixed to plate 26 to prohibit rotation of the collar. In this embodiment, collar 38 is fixed to car 12 by a fastener 40, which includes a bolt 42 and a nut 44.

A shoulder 46 extends about the lower margin of collar 36. Collar 36 serves to retain bolster 18 through cooperation with a conformal shoulder 48, which surrounds bore 38 in bolster 18.

A V-shaped protrusion, or cam, 50 extends upwardly from shoulder 46 along opposite sides of collar 36. Collar 36 may be cast or machined to produce the desired configuration. Protrusion 50 cooperates with a V-shaped notch 52, which is formed in shoulder 48 of bolster 18, on either side of bore 38. In this embodiment, notches 52 are positioned to be parallel to bolster 18's major axis and perpendicular to car axis 32. Notches 52 are integrally formed with bolster 18 during casting or machining of the bolster. Collar 36 and shoulder 46 comprise what is referred to herein as a cam carrier for carrying cam 50.

As depicted in FIG. 1, car 12 has been lifted free of a supporting surface, allowing truck 14 to drop, with bolster 18 coming to rest on shoulder 46 of collar 26. In this condition, V-shaped notch 52 centers on V-shaped protrusion 50. With self-centering cam 34 properly installed on car 12, wheels 22 will be parallel to axis 32, thereby allowing easy placement of car 12 on a straight section of railroad tracks.

Turning now to FIG. 2, a portion of assembly 10 and car 12 is depicted, with truck 14 in its raised position, as would be the case with car 12 resting on a section of track. In this condition, bolster 18 is in contact with plate 26, allowing turning movement of bolster 18 and truck 14 relative to car 12, thereby allowing the car to negotiate curved sections of track. A range of motion of bolster 18 about V-shaped protrusion 50 is depicted, with one extreme being shown in solid lines, and the other extreme of V-shaped protrusion 50 shown in dash-dot lines. This amount of turn may represents a rotation through approximately 25°, which is sufficient to allow the car to negotiate virtually any radius curve which might be found on a model railroad.

Turning now to FIG. 3, a retrofit assembly is partially depicted at 60. In this version, a rail car is shown at 62, and the truck-mounting means for the car is depicted at 64. In this embodiment, mounting means takes the form of a cylindrical protrusion which depends downwardly from the floor of the car. The protrusion may receive a fastener 66, such as a nut and bolt or self tapping screw. Fastener 66 is used rotatably to secure a bolster 68 to the car, thereby to permit movement of the truck assembly relative to the car.

In this embodiment, self-centering cam 34 is arranged with protrusions 50 extending parallel to car axis 32. Bolster 68 is normally provided with a bore extending through its center, which bore receives fastener 66. To retrofit the self-centering truck assembly of the invention to an existing car and truck combination, the original bore in bolster 68 is enlarged. This provides a bore 70 which is of sufficient diameter to allow passage of collar 36 therethrough. A V-shaped notch 72 is formed in bolster 68, as by filing, and cooperates with V-shaped protrusion 50, thus providing for parallel alignment of wheels 22 on assembly 60 with longitudinal axis 32 of car 62.

The assembly disclosed herein, whether provided as new equipment, or retrofit onto existing rolling stock, provides for easy railing of model railroad rolling stock. A car may be placed on the rails by simply holding it above the rails with its trucks in a downward position. This allows the trucks and wheels to come into parallel alignment with the rails of a straight portion of track. The car may then be placed on the rails by engaging the flanges on one side of the car with a single rail and lowering the car such that the wheels on the other side of the car properly engage the rails.

The assembly does not require that addition re-railing devices be constructed on the tracks, nor is it necessary to use any other form of car railing device. Model rail cars may easily be railed by those individuals who do not have precise motor skills. The assembly facilitates re-railing of cars at any location on a model railroad layout.

Although a preferred embodiment of the invention, and a modification thereto, has been disclosed herein, it should be appreciated that variations and modifications may be made thereto without departing from the scope of the invention as defined in the appended claims.

What we claim is:

1. A self-centering model-railroad-car-truck assembly for use on a model railroad car having a longitudinal axis and truck mounting means thereon, comprising:

a truck having an elongate bolster, having a cam-receiving notch therein, extending transversely between the sides thereof; and a cam carrier fixed to the truck mounting means, which includes a collar which extends through said bolster, said collar having a self-centering cam for centering said truck with the car removed from tracks such that the bolster axis is oriented normal to the longitudinal axis of the car.

2. The self-centering truck assembly of claim 1 wherein said bolster includes a bore extending therethrough, said bore being surrounded by a downward facing shoulder having a V-shaped notch formed therein, and wherein said collar is clearance fittable through said bore and includes a V-shaped protrusion thereon which is received in said V-shaped notch.

3. The self-centering truck assembly of claim 2 wherein said V-shaped notch is integrally formed with said shoulder and extends parallel to the axis of said bolster.

4. The self-centering truck assembly of claim 2 wherein said V-shaped notch extends normal to the axis of said bolster.

5. A self-centering model-railroad-car-truck assembly for use on a model railroad car having a longitudinal axis and truck mounting means thereon, comprising:

a truck having a bolster extending transversely between the sides thereof, said bolster having a bore extending vertically therethrough for securing said truck to the truck mounting means, said bolster further having a V-shaped notch formed therein; and a centering cam which is receivable in said V-shaped notch for aligning said truck with the longitudinal axis of the car when the car is held upright with said truck depending downwardly therefrom.

6. The self-centering truck assembly of claim 5 wherein said centering cam includes a collar which extends through said bore in said bolster, said collar having a cylindrical portion extending through said bore and a shoulder portion for contacting the lower surface of said bolster, and a V-shaped protrusion extending upward from said shoulder portion which is conformal with said V-shaped notch.

7. The self-centering truck assembly of claim 6 wherein said collar is non-rotatably fixed to said truck mounting means by a fastener which extends through said collar and into said truck mounting means.

* * * * *